US010702756B2

(12) United States Patent
Bell et al.

(10) Patent No.: US 10,702,756 B2
(45) Date of Patent: Jul. 7, 2020

(54) ROCK CLIMBING FALL ZONES

(71) Applicant: International Business Machines Corporation, Armonk, NY (US)

(72) Inventors: Denise Bell, Austin, TX (US); Jana H. Jenkins, Raleigh, NC (US); Jeffrey A. Kusnitz, Campbell, CA (US); Adriana A. Morales, Travis County, TX (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 71 days.

(21) Appl. No.: 16/057,956

(22) Filed: Aug. 8, 2018

(65) Prior Publication Data

US 2020/0047048 A1 Feb. 13, 2020

(51) Int. Cl.

| | |
|---|---|
| ***A63B 69/00*** | (2006.01) |
| ***A63B 24/00*** | (2006.01) |
| ***A63B 71/06*** | (2006.01) |

(52) U.S. Cl.

CPC ..... *A63B 69/0048* (2013.01); *A63B 24/0062* (2013.01); *A63B 71/0622* (2013.01); *A63B 2071/0694* (2013.01); *A63B 2207/02* (2013.01); *A63B 2220/56* (2013.01)

(58) Field of Classification Search

CPC ..... A63B 69/0048; A63B 71/0622; A63B 24/0062; A63B 2071/0694; A63B 2207/02; A63B 2220/56

See application file for complete search history.

(56) References Cited

U.S. PATENT DOCUMENTS

| | | | | |
|---|---|---|---|---|
| 7,490,610 | B2 | 2/2009 | Franklin | |
| 8,668,626 | B1 | 3/2014 | Horowitz et al. | |
| 8,808,145 | B1 | 8/2014 | Parsons et al. | |
| 9,132,330 | B2 | 9/2015 | Brendle | |
| 9,492,725 | B2 | 11/2016 | Jones | |
| 9,539,483 | B1 | 1/2017 | Tsang | |
| 2010/0004098 | A1 | 1/2010 | Hensley | |
| 2017/0099424 | A1* | 4/2017 | Jones | G05D 1/0094 |
| 2018/0318626 | A1* | 11/2018 | Jones | A63B 69/0048 |

FOREIGN PATENT DOCUMENTS

| | | |
|---|---|---|
| WO | 03015598 A2 | 2/2003 |

* cited by examiner

*Primary Examiner* — Sundhara M Ganesan
(74) *Attorney, Agent, or Firm* — Cantor Colburn LLP; Teddi Maranzano

(57) ABSTRACT

Examples of techniques for projecting fall zones for a climber are disclosed. In one example implementation according to aspects of the present disclosure, a computer-implemented method includes detecting, by a processing device, a position of a climber on a climbing surface. The method further includes determining, by the processing device, a fall zone of the climber based at least in part on the position of the climber on the climbing surface. The method further includes projecting the fall zone of the climber on a ground surface beneath the climber, the fall zone being visible to others.

20 Claims, 5 Drawing Sheets

ROCK CLIMBING FALL ZONES

BACKGROUND

The present invention generally relates to rock climbing, and more specifically, to safety support for rock climbing fall zones.

Rock climbing is a popular recreational activity for many. When rock climbing, climbers climb up, down, and across natural rock formations and artificial rock walls. Artificial rock walls, which may be located indoors or outdoors, can include one or more predefined routes. It is the climber's objective to traverse one of the predefined routes without falling. The routes can be defined by specific holds that are to be used. Although other holds may be in proximity, these other holds may not be used by the climber because they are not included in the route which the climber is traversing. These other holds may be part of other predefined routes.

When climbing natural rock formations and artificial rock walls, it is not uncommon for a climber to fall. Safety equipment is designed to lessen the risk to the climber when falling.

SUMMARY

Embodiments of the present invention are directed to a computer-implemented method for projecting a fall zone for a climber. A non-limiting example of the computer-implemented method includes detecting, by a processing device, a position of a climber on a climbing surface. The method further includes determining, by the processing device, a fall zone of the climber based at least in part on the position of the climber on the climbing surface. The method further includes projecting the fall zone of the climber on a ground surface beneath the climber, the fall zone being visible to others.

Embodiments of the present invention are directed to a system. A non-limiting example of the system includes a memory comprising computer readable instructions and a processing device for executing the computer readable instructions for performing a method for projecting a fall zone for a climber. A non-limiting example of the method includes detecting, by a processing device, a position of a climber on a climbing surface. The method further includes determining, by the processing device, a fall zone of the climber based at least in part on the position of the climber on the climbing surface. The method further includes projecting the fall zone of the climber on a ground surface beneath the climber, the fall zone being visible to others.

Embodiments of the invention are directed to a computer program product. A non-limiting example of the computer program product includes a computer readable storage medium having program instructions embodied therewith. The program instructions are executable by a processor to cause the processor to perform a method for projecting a fall zone for a climber. A non-limiting example of the method includes detecting, by a processing device, a position of a climber on a climbing surface. The method further includes determining, by the processing device, a fall zone of the climber based at least in part on the position of the climber on the climbing surface. The method further includes projecting the fall zone of the climber on a ground surface beneath the climber, the fall zone being visible to others.

Additional technical features and benefits are realized through the techniques of the present invention. Embodiments and aspects of the invention are described in detail herein and are considered a part of the claimed subject matter. For a better understanding, refer to the detailed description and to the drawings.

BRIEF DESCRIPTION OF THE DRAWINGS

The specifics of the exclusive rights described herein are particularly pointed out and distinctly claimed in the claims at the conclusion of the specification. The foregoing and other features and advantages of the embodiments of the invention are apparent from the following detailed description taken in conjunction with the accompanying drawings in which:

Figure 1:
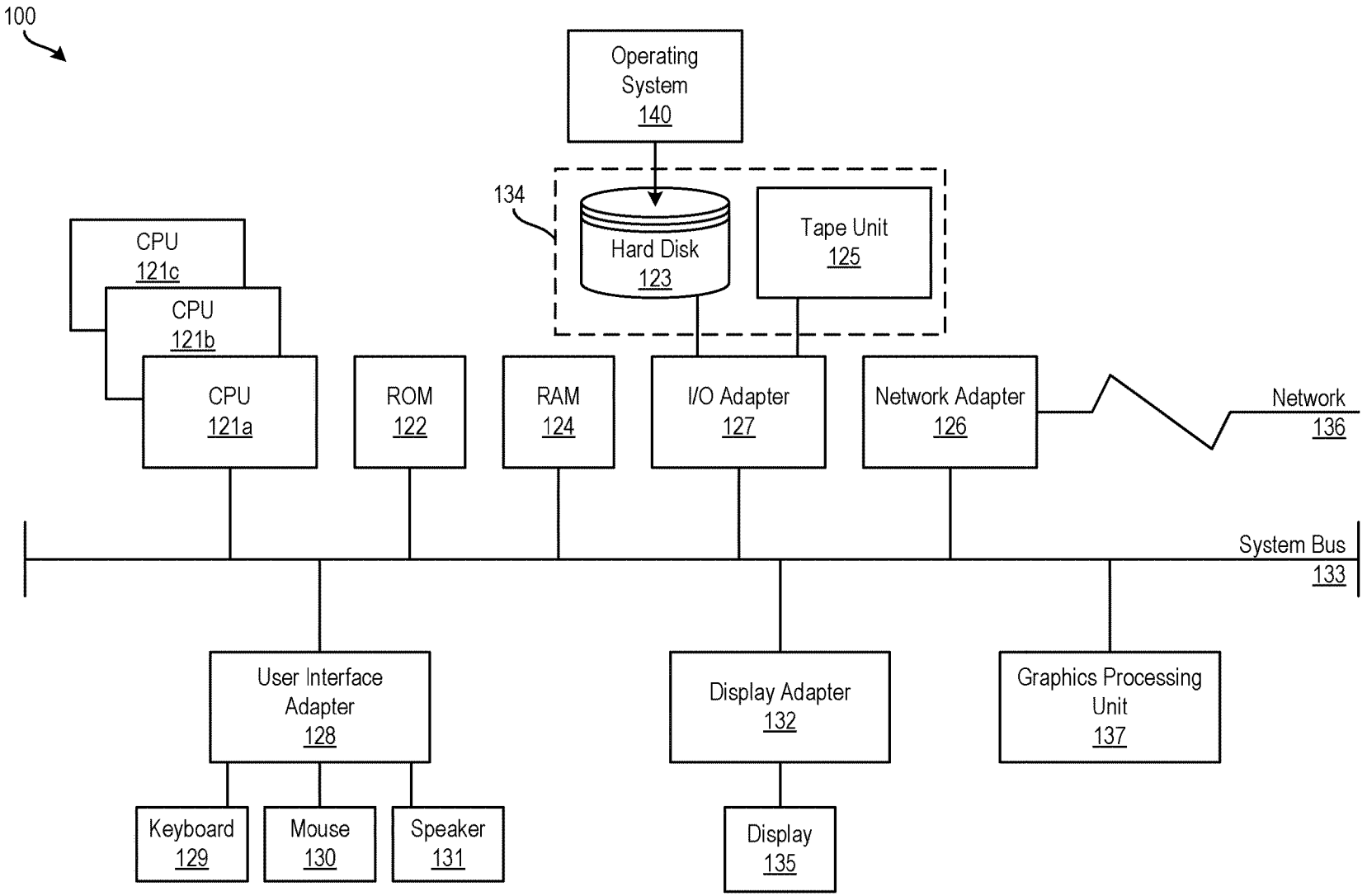
FIG. 1 depicts a block diagram of a processing system for implementing the techniques described herein according to aspects of the present disclosure.

The diagrams depicted herein are illustrative. There can be many variations to the diagram or the operations described therein without departing from the spirit of the invention. For instance, the actions can be performed in a differing order or actions can be added, deleted or modified. Also, the term "coupled" and variations thereof describes having a communications path between two elements and does not imply a direct connection between the elements with no intervening elements/connections between them. All of these variations are considered a part of the specification.

In the accompanying figures and following detailed description of the disclosed embodiments, the various elements illustrated in the figures are provided with two or three digit reference numbers. With minor exceptions, the leftmost digit(s) of each reference number correspond to the figure in which its element is first illustrated.

DETAILED DESCRIPTION

Various embodiments of the invention are described herein with reference to the related drawings. Alternative embodiments of the invention can be devised without departing from the scope of this invention. Various connections and positional relationships (e.g., over, below, adjacent, etc.) are set forth between elements in the following description and in the drawings. These connections and/or positional relationships, unless specified otherwise, can be direct or indirect, and the present invention is not intended to be limiting in this respect. Accordingly, a coupling of entities can refer to either a direct or an indirect coupling, and a positional relationship between entities can be a direct or indirect positional relationship. Moreover, the various tasks and process steps described herein can be incorporated into a more comprehensive procedure or process having additional steps or functionality not described in detail herein.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" may be understood to include any integer number greater than or equal to one, i.e. one, two, three, four, etc. The terms "a plurality" may be understood to include any integer number greater than or equal to two, i.e. two, three, four, five, etc. The term "connection" may include both an indirect "connection" and a direct "connection."

The terms "about," "substantially," "approximately," and variations thereof, are intended to include the degree of error associated with measurement of the particular quantity based upon the equipment available at the time of filing the application. For example, "about" can include a range of ±8% or 5%, or 2% of a given value.

It is understood that the present disclosure is capable of being implemented in conjunction with any other type of computing environment now known or later developed. For example, FIG. 1 depicts a block diagram of a processing system 100 for implementing the techniques described herein. In examples, processing system 100 has one or more central processing units (processors) 121*a*, 121*b*, 121*c*, etc. (collectively or generically referred to as processor(s) 121 and/or as processing device(s)). In aspects of the present disclosure, each processor 121 can include a reduced instruction set computer (RISC) microprocessor. Processors 121 are coupled to system memory (e.g., random access memory (RAM) 124) and various other components via a system bus 133. Read only memory (ROM) 122 is coupled to system bus 133 and may include a basic input/output system (BIOS), which controls certain basic functions of processing system 100.

Further depicted are an input/output (I/O) adapter 127 and a network adapter 126 coupled to system bus 133. I/O adapter 127 may be a small computer system interface (SCSI) adapter that communicates with a hard disk 123 and/or a tape storage drive 125 or any other similar component. I/O adapter 127, hard disk 123, and tape storage device 125 are collectively referred to herein as mass storage 134. Operating system 140 for execution on processing system 100 may be stored in mass storage 134. The network adapter 126 interconnects system bus 133 with an outside network 136 enabling processing system 100 to communicate with other such systems.

A display (e.g., a display monitor) 135 is connected to system bus 133 by display adaptor 132, which may include a graphics adapter to improve the performance of graphics intensive applications and a video controller. In one aspect of the present disclosure, adapters 126, 127, and/or 132 may be connected to one or more I/O busses that are connected to system bus 133 via an intermediate bus bridge (not shown). Suitable I/O buses for connecting peripheral devices such as hard disk controllers, network adapters, and graphics adapters typically include common protocols, such as the Peripheral Component Interconnect (PCI). Additional input/output devices are shown as connected to system bus 133 via user interface adapter 128 and display adapter 132. A keyboard 129, mouse 130, and speaker 131 may be interconnected to system bus 133 via user interface adapter 128, which may include, for example, a Super I/O chip integrating multiple device adapters into a single integrated circuit.

In some aspects of the present disclosure, processing system 100 includes a graphics processing unit 137. Graphics processing unit 137 is a specialized electronic circuit designed to manipulate and alter memory to accelerate the creation of images in a frame buffer intended for output to a display. In general, graphics processing unit 137 is very efficient at manipulating computer graphics and image processing, and has a highly parallel structure that makes it more effective than general-purpose CPUs for algorithms where processing of large blocks of data is done in parallel.

Thus, as configured herein, processing system 100 includes processing capability in the form of processors 121, storage capability including system memory (e.g., RAM 124), and mass storage 134, input means such as keyboard 129 and mouse 130, and output capability including speaker 131 and display 135. In some aspects of the present disclosure, a portion of system memory (e.g., RAM 124) and mass storage 134 collectively store an operating system such as the AIX® operating system from IBM Corporation to coordinate the functions of the various components shown in processing system 100.

Turning now to an overview of technologies that are more specifically relevant to aspects of the invention, the present technical solutions relate to safety support for rock climbing fall zones. When a climber is climbing a natural rock formation or an artificial rock wall, it is not uncommon for the climber to fall. For example, a hold breaks, a climber loses his balance and slips, the climber becomes exhausted, etc. Safety equipment (such as ropes, harnesses, and the like) lessens the risk to the climber when falling. However, this safety equipment is conventionally focused on the climber and not on others in proximity to the climber. For example, in the case of an indoor artificial rock wall, spectators may be in proximity to the climber, observing the climber, waiting to climb, recovering from a previous climb, etc.

Sometimes, those in proximity (in the same general area as the climber and/or climbing surface, such as an artificial rock wall) to the climber enter into the climber's "fall zone." A fall zone is the area under a climber that follows the climber as he traverses a route. For example, the fall zone can be considered an approximate 5 foot diameter circle under the climber. If the climber falls, the fall zone is the area in which he is likely to land. When a climber falls, there is a risk of injury to the climber or to another person if the other person is within the climber's fall zone. Although convention safety equipment may prevent injury to the climber due to the fall, conventional safety equipment will not protect those in proximity to the climber. For example, if a person in proximity to the climber stands or passes within the climber's fall zone, the person is likely to be hit by the climber if the climber falls. This can result in injury to the person within the fall zone and can cause additional injury to the climber who might have otherwise been protected by safety equipment (such as a padded mat on the floor beneath an artificial rock wall). Those in proximity to a climber should not walk under a climber on a wall or place items within a climber's fall zone and should maintain a respectable distance if the climber performs a dynamic jump from one hold to the next. In busy rock climbing gyms with many climbers climbing at once, it may be difficult for bystanders or others not climbing at that moment to identify various fall zones of the different climbers.

Turning now to an overview of the aspects of the invention, one or more embodiments of the invention address the above-described shortcomings of the prior art by providing safety support for rock climbing fall zones. In particular, the technical solutions described herein represent improvements over conventional rock climbing safety equipment by projecting a predictive fall zone that is observable by others in proximity to the climber. This enables those around, under, or otherwise in proximity to the climber to observe the climber's fall zone and take precautions to avoid the fall zone.

The above-described aspects of the invention address the shortcomings of the prior art by detecting a climber's location, determining a fall zone associated with the climber, and projecting the fall zone so that the fall zone is visible (and thus avoidable) by others. Conventional approaches require others around the climber to be aware of the fall zone without any visual indication thereof, while the present techniques non-conventionally project the fall zone so that it is visible by others.

Figure 2:
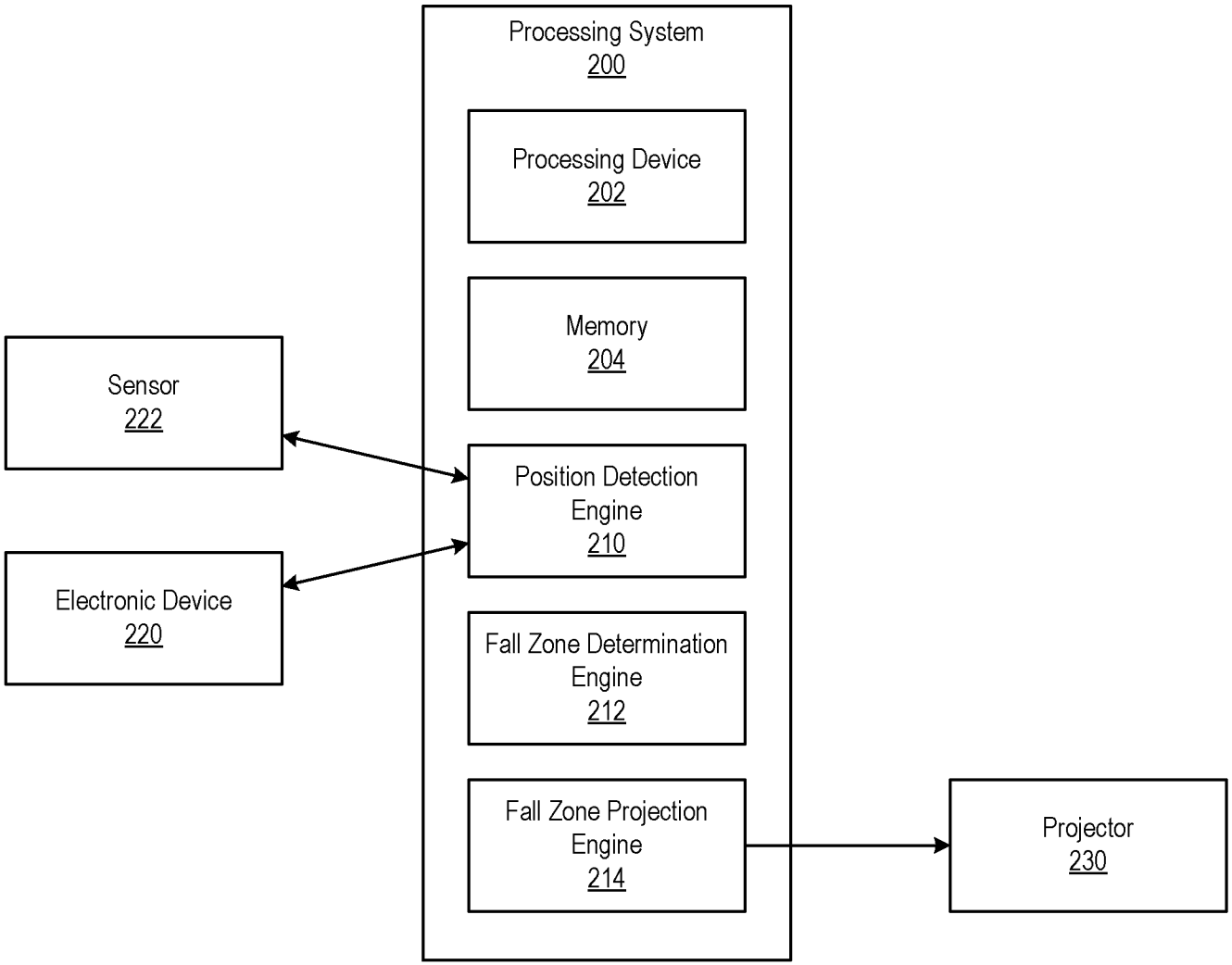
FIG. 2 depicts a block diagram of a processing system for projecting a fall zone of a climber on a ground surface beneath the climber according to one or more embodiments described herein.

Turning now to a more detailed description of aspects of the present invention, FIG. 2 depicts a block diagram of a processing system 200 for projecting a fall zone of a climber on a ground surface beneath the climber according to one or more embodiments described herein. The processing system 200 includes a processing device 202, a memory 204, a position detection engine 210, a fall zone determination engine 212, and a fall zone projection engine 214. The processing system 200 can be communicatively coupled (via any suitable wired and/or wireless network or peer-to-peer communication link) to an electronic device 220, a sensor 222, and a projector 230.

The various components, modules, engines, etc. described regarding FIG. 2 can be implemented as instructions stored on a computer-readable storage medium, as hardware modules, as special-purpose hardware (e.g., application specific hardware, application specific integrated circuits (ASICs), application specific special processors (ASSPs), field programmable gate arrays (FPGAs), as embedded controllers, hardwired circuitry, etc.), or as some combination or combinations of these. According to aspects of the present disclosure, the engine(s) described herein can be a combination of hardware and programming. The programming can be processor executable instructions stored on a tangible memory, and the hardware can include the processing device 202 for executing those instructions. Thus a system memory (e.g., the memory 204) can store program instructions that when executed by the processing device 202 implement the engines described herein. Other engines can also be utilized to include other features and functionality described in other examples herein.

Figure 3:
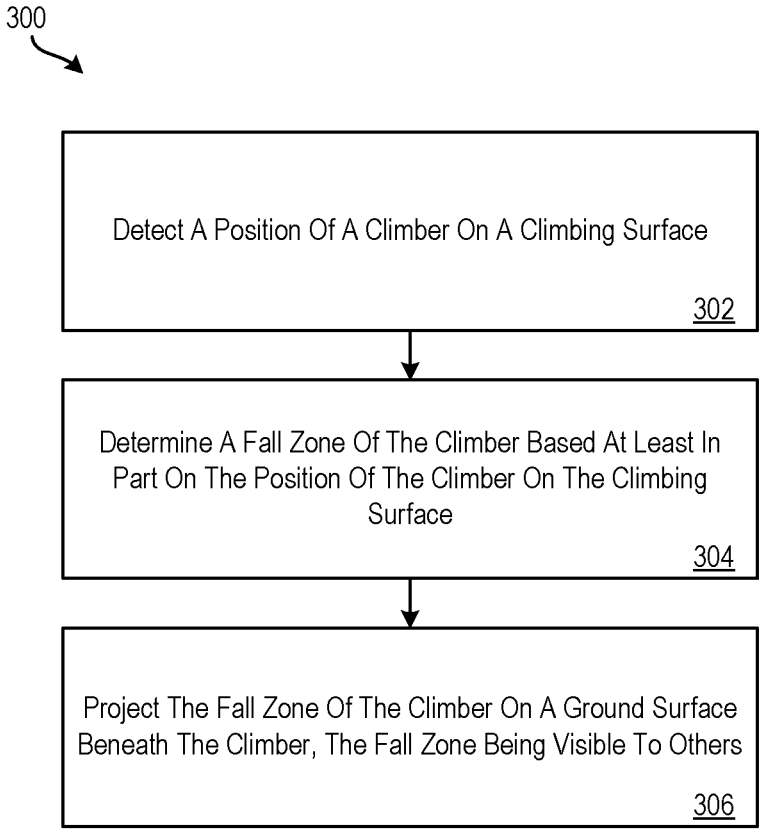
FIG. 3 depicts a flow diagram of a method for projecting a fall zone of a climber on a ground surface beneath the climber according to one or more embodiments described herein.

The functionality of the position detection engine 210, the fall zone determination engine 212, and the fall zone projection engine are now described with reference to FIG. 3. In particular, FIG. 3 depicts a flow diagram of a method 300 for projecting a fall zone of a climber on a ground surface beneath the climber according to one or more embodiments described herein. The method 300 can be implemented using any suitable processing system and/or processing device, such as the processing system 100, the processing system 200, the processing device 202, and the like.

At block 302, the position detection engine 210 detects a position of a climber on a climbing surface (e.g., an artificial rock wall, a natural rock formation, etc.). The position detection engine 210 can detect the position of a climber in a number of ways. For example, the position detection engine 210 can receive a signal from an electronic device 220 (e.g., a specialized device attached to the climber and configured to communicate with the position detection engine 210, a smart phone, a wearable computing device, etc.) associated with the climber. The position detection engine 210 can use the signal to detect the position of the climber, such as using triangulation techniques, GPS, etc.

In another example, the position detection engine 210 can receive a signal from a sensor 222 (or multiple sensors) that are associated with holds used by the climber to traverse the climbing surface. For example, each hold can include a pressure sensor (e.g., the sensor 222) that detects when pressure is applied, thus indicating that the hold is in use. In another example, each hold can include a near field communication (NFC) sensor (e.g., the sensor 222) that detects when the electronic device 220 of the climber is within a certain range of the hold, thus indicating that the hold is in use. A signal indicative of the hold being in use can be sent to the position detection engine 210, and the position detection engine 210 can use the signal to detect the position of the climber.

In some examples, the holds can also include a light source such as an LED light or other suitable light that illuminates when the hold is associated with a route that the climber is traversing on the climbing surface. For example, if a climbing surface includes three routes (green, yellow, and orange), and the climber is climbing the orange route, each of the orange holds can illuminate while the green and yellow holds do not illuminate. This has a two-fold effect: first, it visually shows the climber where to climb, and second, it shows other climbers to avoid the illuminated holds. In another example, holds that are part of a route the climber is climbing can illuminate a first color (e.g., green) to show the route is in use; holds that are not part of the route can illuminate in a second color (e.g., red) to show that these other holds should not be used, such as by the climber or by other climbers. This increases safety by communicating to the climbers which routes/holds are safe or available and which routes/holds are not.

At block 304, the fall zone determination engine 212 determines a fall zone of the climber based at least in part on the position of the climber on the climbing surface. The fall zone can be determined based on different factors, such a climber's physical dimensions (e.g., height), the location of the climber relative to the climbing surface and/or the ground surface beneath the climber, the orientation of the climbing surface, a type of climbing (e.g., bouldering versus standard climbing), an experience level of the climber, a difficulty level of the route, historical data, etc.

The following are some examples of how the fall zone determination engine 212 can determine a fall zone. For example, a fall zone can be determined to be the same size as the height of a climber (e.g., a fall zone is a 5 foot 10 inch circle for a climber who is 5 feet 10 inches tall). The fall zone can be larger for a climber who is bouldering than for a climber who is performing standard climbing because bouldering may include more dynamic jumps between holds and thus a larger fall zone may be determined. A fall zone may be larger for a climber who is higher in the air than for a climber who is close to the ground.

Once the fall zone is determined, the method proceeds to block 306 and the fall zone projection engine 214 projects the fall zone of the climber on a ground surface beneath the climber. It should be appreciated that the fall zone is visible, such as to the climbers and those around (in proximity to) the climber. By projecting the fall zone, which is determined as described herein, other climbers/bystanders are made aware of the area of a climber's potential fall, thus improving everyone's safety.

Additional processes also may be included. For example, position detection engine 210 can determine a route of the climber for traversing the climbing surface. The fall zone determination engine 212 can then determine an adjusted fall zone of the climber when the climber moves along the route. This enables the fall zone to move when the climber moves. The adjusted fall zone can be adjusted in terms of size, location, orientation, shape, etc. The fall zone projection engine 214 can project the adjusted fall zone on the ground surface beneath the climber.

In some examples, multiple climbers can be climbing different routes on a climbing surface concurrently. In such cases, the position detection engine 210 detects a position of a second climber on the climbing surface. The fall zone determination engine 212 then determines a fall zone of the second climber based on the position of the second climber on the climbing surface, and the fall zone projection engine 214 projects the fall zone of the second climber on the ground surface beneath the second climber while projecting the fall zone of the first climber on the ground surface beneath the first climber. If the two projected fall zones overlap, corrective measures can be taken, such as changing the lights on the holds, issuing an audible, tactile, and/or visual alert to one or both of the climbers, etc.

It should be understood that the process depicted in FIG. 3 represents an illustration, and that other processes may be added or existing processes may be removed, modified, or rearranged without departing from the scope and spirit of the present disclosure.

Figure 4:
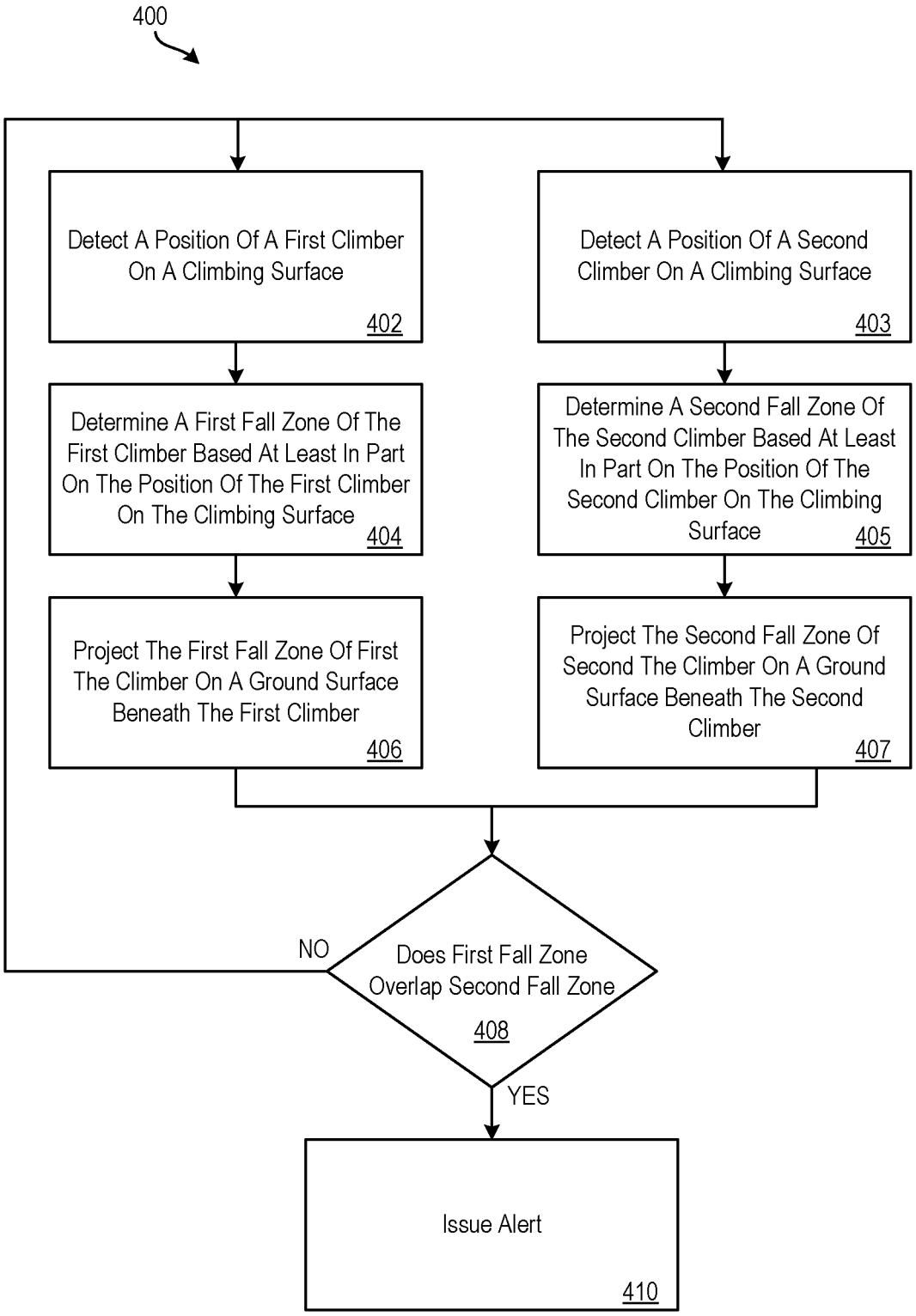
FIG. 4 depicts a flow diagram of a method for projecting a fall zone of a climber on a ground surface beneath the climber according to one or more embodiments described herein.

FIG. 4 depicts a flow diagram of a method 400 for projecting a fall zone of a climber on a ground surface beneath the climber according to one or more embodiments described herein. The method 400 can be implemented using any suitable processing system and/or processing device, such as the processing system 100, the processing system 200, the processing device 202, and the like.

At block 402, the position detection engine 210 detects a position of a first climber on a climbing surface (e.g., an artificial rock wall, a natural rock formation, etc.) and at block 403 detects a position of a second climber on a climbing surface. At block 404, the fall zone determination engine 412 determines a first fall zone of the first climber and at block 405 determines a second fall zone of the second climber. At block 406, the fall zone projection engine 414 projects the first fall zone of the first climber on a ground surface beneath the first climber and at block 407 projects the second fall zone of the second climber on a ground surface beneath the second climber.

At decision block 408, it is determined whether the first fall zone and the second fall zone overlap. If not, the method 400 restarts such that the position of the climbers are detected and the climbers are monitored as the progress up/across/down the climbing surface. However, if at decision block 408 it is determined that the first and second fall zones overlap, the processing system 200 can issue an alert to warn the climbers that the fall zones overlap at block 410.

Additional processes also may be included, and it should be understood that the process depicted in FIG. 4 represents an illustration, and that other processes may be added or existing processes may be removed, modified, or rearranged without departing from the scope and spirit of the present disclosure.

Figure 5:
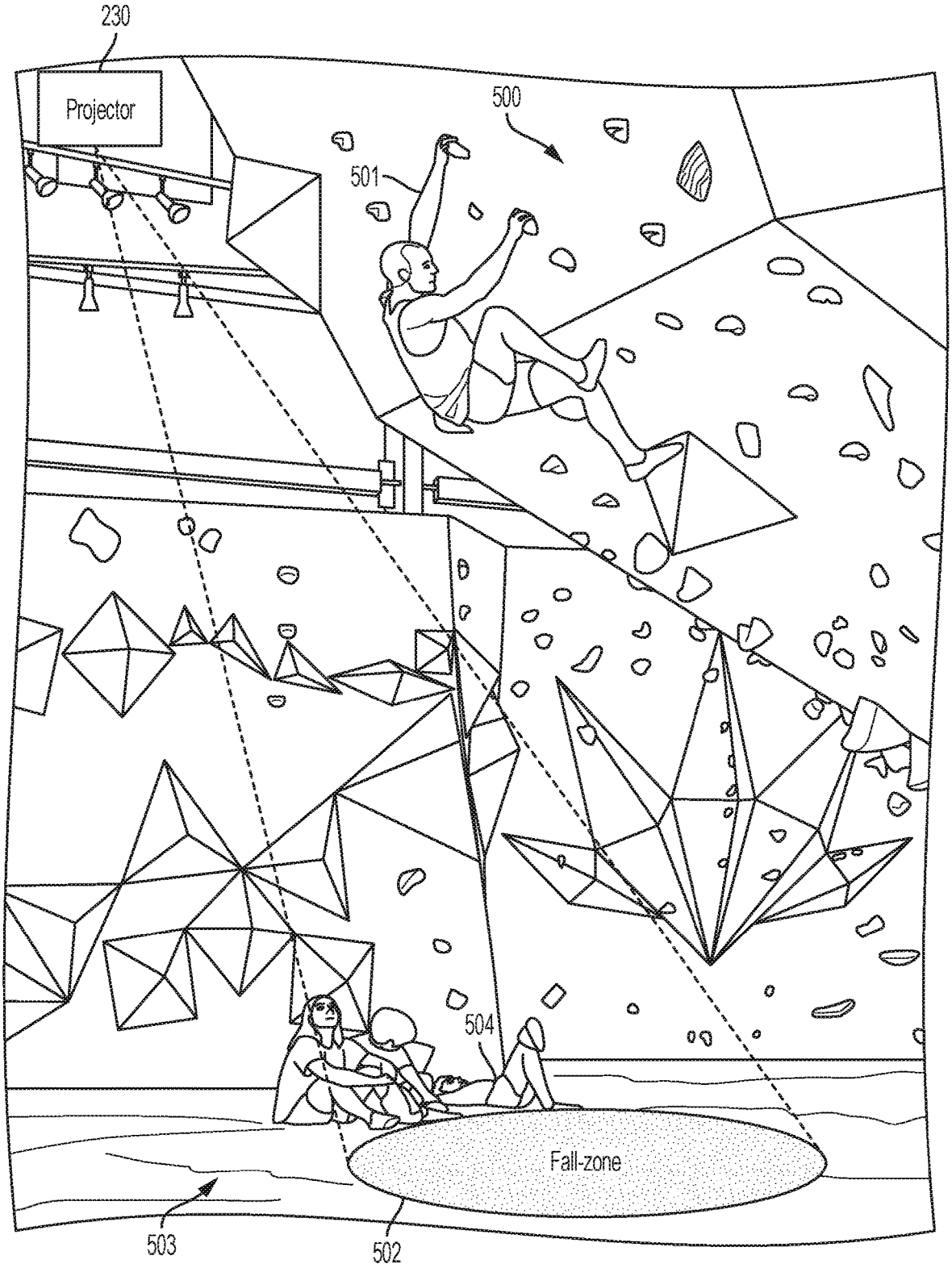
FIG. 5 depicts a climbing surface and a projected fall zone for a climber climbing the climbing surface according to one or more embodiments described herein.

FIG. 5 depicts a climbing surface 500 and a projected fall zone 502 for a climber 501 climbing the climbing surface 500 according to one or more embodiments described herein. In this example, the processing system 200 has detected the position of the climber 501 on the climbing surface 500 and has determined the fall zone 502 for the climber 501. The fall zone 502 is projected by the projector 230, which can be any suitable device for projecting an image, light, etc., onto a ground surface 503 below the climber 501.

As shown in FIG. 5, an observer 504 is located (at least partially) within the fall zone. Thus, if the climber 501 were to fall, it is likely that the climber 501 would collide with the observer 504, causing potential injury to one or both of the climber 41 and the observer 504. By projecting the fall zone 502 onto the ground surface 503, the safety of the climber 501 and the observer 504 are increased because the observer 504 can observe the fall zone 502 and take corrective action to avoid the fall zone 502. In some embodiments described herein, the processing system 200 can issue an audible, visual, and/or tactile warning if someone enters the fall zone.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instruction by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments described herein.

What is claimed is:

1. A computer-implemented method comprising:

detecting, by a processing device, a position of a climber on a climbing surface;

determining, by the processing device, a fall zone of the climber based at least in part on the position of the climber on the climbing surface; and projecting the fall zone of the climber on a ground surface beneath the climber, the fall zone being visible to others.

2. The computer-implemented method of claim 1, further comprising:

determining, by the processing device, a route of the climber for traversing the climbing surface.

3. The computer-implemented method of claim 2, further comprising:

determining, by the processing device, an adjusted fall zone of the climber based at least in part on the climber moving along the route; and projecting the adjusted fall zone on the ground surface beneath the climber, the adjusted fall zone being visible to others.

4. The computer-implemented method of claim 1, wherein detecting the position of the climber on the climbing surfaces comprises receiving a signal from an electronic device associated with the climber.

5. The computer-implemented method of claim 1, wherein detecting the position of the climber on the climbing surface comprises receiving a signal from a sensor associated with at least one of a plurality of holds on the climbing surface.

6. The computer-implemented method of claim 5, wherein at least one of the plurality of holds further comprise a light source.

7. The computer-implemented method of claim 6, wherein the light source illuminates when the at least one of the plurality of holds is associated with a route of the climber for traversing the climbing surface.

8. The computer-implemented method of claim 6, wherein the light source illuminates a first color when the at least one of the plurality of holds is associated with a route of the climber for traversing the climbing surface, and wherein the light source illuminates a second color when the at least one of the plurality of holds is not associated with the route of the climber.

9. The computer-implemented method of claim 1, wherein the climber is a first climber, the computer-implemented method further comprising:

detecting, by a processing device, a position of a second climber on the climbing surface;

determining, by the processing device, a fall zone of the second climber based at least in part on the position of the second climber on the climbing surface; and projecting the fall zone of the second climber on a ground surface beneath the second climber while projecting the fall zone of the first climber on the ground surface beneath the first climber.

10. A system comprising:

a memory comprising computer readable instructions; and a processing device for executing the computer readable instructions for performing a method comprising:

detecting, by the processing device, a position of a climber on a climbing surface;

determining, by the processing device, a fall zone of the climber based at least in part on the position of the climber on the climbing surface; and projecting the fall zone of the climber on a ground surface beneath the climber, the fall zone being visible to others.

11. The system of claim 10, wherein the method further comprises:

determining, by the processing device, a route of the climber for traversing the climbing surface.

12. The system of claim 11, wherein the method further comprises:

determining, by the processing device, an adjusted fall zone of the climber based at least in part on the climber moving along the route; and projecting the adjusted fall zone on the ground surface beneath the climber, the adjusted fall zone being visible to others.

13. The system of claim 10, wherein detecting the position of the climber on the climbing surfaces comprises receiving a signal from an electronic device associated with the climber.

14. The system of claim 10, wherein detecting the position of the climber on the climbing surface comprises receiving a signal from a sensor associated with at least one of a plurality of holds on the climbing surface.

15. The system of claim 14, wherein at least one of the plurality of holds further comprise a light source.

16. The system of claim 15, wherein the light source illuminates when the at least one of the plurality of holds is associated with a route of the climber for traversing the climbing surface.

17. The system of claim 15, wherein the light source illuminates a first color when the at least one of the plurality of holds is associated with a route of the climber for traversing the climbing surface, and wherein the light source illuminates a second color when the at least one of the plurality of holds is not associated with the route of the climber.

18. The system of claim 10, wherein the climber is a first climber, the computer-implemented method further comprising:

detecting, by a processing device, a position of a second climber on the climbing surface;

determining, by the processing device, a fall zone of the second climber based at least in part on the position of the second climber on the climbing surface; and projecting the fall zone of the second climber on a ground surface beneath the second climber while projecting the fall zone of the first climber on the ground surface beneath the first climber.

19. A computer program product comprising:

a computer readable storage medium having program instructions embodied therewith, the program instructions executable by a processing device to cause the processing device to perform a method comprising:

detecting, by the processing device, a position of a climber on a climbing surface;

determining, by the processing device, a fall zone of the climber based at least in part on the position of the climber on the climbing surface; and projecting the fall zone of the climber on a ground surface beneath the climber, the fall zone being visible to others.

20. The computer program product of claim 19, wherein the method further comprises:

determining, by the processing device, a route of the climber for traversing the climbing surface;

determining, by the processing device, an adjusted fall zone of the climber based at least in part on the climber moving along the route; and projecting the adjusted fall zone on the ground surface beneath the climber, the adjusted fall zone being visible to others.

* * * * *